US005673768A

United States Patent [19]

Schmitt et al.

[11] Patent Number: 5,673,768

[45] Date of Patent: Oct. 7, 1997

[54] LADDER WEAR PROTECTION DEVICE

[75] Inventors: Thomas J. Schmitt, Louisville; Paul R. Swiderski, Georgetown, both of Ky.

[73] Assignee: Emerson Electric Co., St. Louis, Mo.

[21] Appl. No.: 594,642

[22] Filed: Feb. 2, 1996

[51] Int. Cl.[6] ..... A47B 95/00

[52] U.S. Cl. ..... 182/129; 248/345.1; 403/11; 403/23

[58] Field of Search ..... 248/345.1; 182/129; 403/11, 23, 344

[56] References Cited

U.S. PATENT DOCUMENTS

| | | | |
|---|---|---|---|
| 404,300 | 5/1889 | Perkins | 403/433 X |
| 3,752,515 | 8/1973 | Oaks et al. | 403/344 |
| 3,935,926 | 2/1976 | Butler | 182/208 |
| 4,408,924 | 10/1983 | Huebner | 403/23 |
| 4,898,492 | 2/1990 | Janowski | 403/344 X |
| 4,955,574 | 9/1990 | Freier | 403/344 X |
| 5,118,215 | 6/1992 | Freier | 403/344 X |

FOREIGN PATENT DOCUMENTS

| | | | |
|---|---|---|---|
| 2419422 | 11/1979 | France | 403/344 |
| 580779 | 10/1976 | Switzerland | 403/344 |
| 679178 | 12/1991 | Switzerland | 403/344 |
| 2241986 | 9/1991 | United Kingdom | 403/344 |

*Primary Examiner*—Ramon O. Ramirez
*Assistant Examiner*—Stephen S. Wentsler
*Attorney, Agent, or Firm*—Polster, Lieder, Woodruff & Lucchesi

[57] ABSTRACT

A wear protection device for disposition between two relatively moveable members and particularly adapted for use for protecting rungs of extension ladders, the protection device being mountable on a ladder rung, the device including a fastener guide to enhance fixing and firmly gripping the device in place on the ladder rung.

12 Claims, 2 Drawing Sheets

LADDER WEAR PROTECTION DEVICE

BACKGROUND OF THE INVENTION

The present invention relates to a wear protection device to be disposed between two relatively moveable members and more particularly to a unique wear sleeve for disposition between a relatively moveable rung of one end-to-end section of an extensible ladder and a rail of an adjacent end-to-end ladder section.

It long has been known to minimize surface contact between the relatively moveable base and fly sections of extensible ladders, attention being directed to the guide and cut protector pad units fastened to the side rails of a ladder section of an extensible ladder as disclosed in expired U.S. Pat. No. 3,935,926, issued to J. A. Butler on Feb. 3, 1976. It also has been known to utilize elongated wear sleeve members between relatively moveable ladder rail and rungs of adjacent end-to-end ladder sections of extensible ladders by surrounding the extremities of preselected rungs with such elongated wear sleeve members and then riveting the wear sleeve members to the rung extremities so that a portion of each wear sleeve member is positioned between the relatively moveable ladder rail and rung members, thus minimizing wear between the parts. In the past, the utilization of wear sleeves has proven to be relatively difficult and comparatively labor intensive in manufacturing operations.

In accordance with the present invention, a unique wear sleeve arrangement is provided which is straightforward and economical to manufacture and assemble, permitting efficient and facile mounting of the inventive wear sleeve to a preselected ladder rung, assuring that the sleeve is firmly gripped in place for further fastening operations and, at the same time, providing a convenient and straight forward tool guide for such further fastening operations.

Various other features of the present invention will become obvious to one skilled in the art upon reading the disclosure set forth herein.

BRIEF SUMMARY OF THE INVENTION

More particularly, the present invention provides a unique and novel wear protection device for disposition between two relatively moveable members comprising: an elongated wear sleeve conformably mountable to a preselected portion of at least one of the two relatively moveable members to provide a wear surface at preselected location therebetween; gripping structure associated with the wear sleeve to grip the sleeve firmly in the preselected location; and, fastened means to fix the firmly gripped wear sleeve in the preselected location.

It is to be understood that various changes can be made by one skilled in the art in one or mere of the several parts of the structure disclosed without departing from the scope or spirit of the invention. For example, the configuration and geometry of the gripping structure and the hinge structure as disclosed can be readily changed to accommodate for the wear protection material used, as can the type of wear material employed.

BRIEF DESCRIPTION OF THE DRAWINGS

Referring to the drawings which disclose one advantageous embodiment of the present invention and a modification thereof.

DETAILED DESCRIPTION OF THE DRAWINGS

Figure 1:
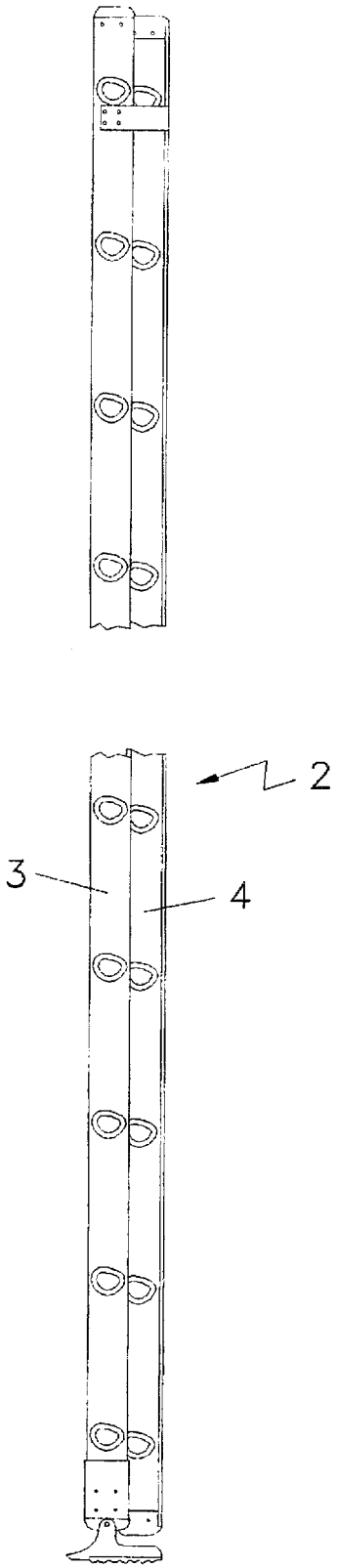
In FIG. 1 is a view in side elevation, partly broken away, showing the base and fly section of an extensible ladder incorporating the novel rung wear sleeve of the present invention.
Figure 2:
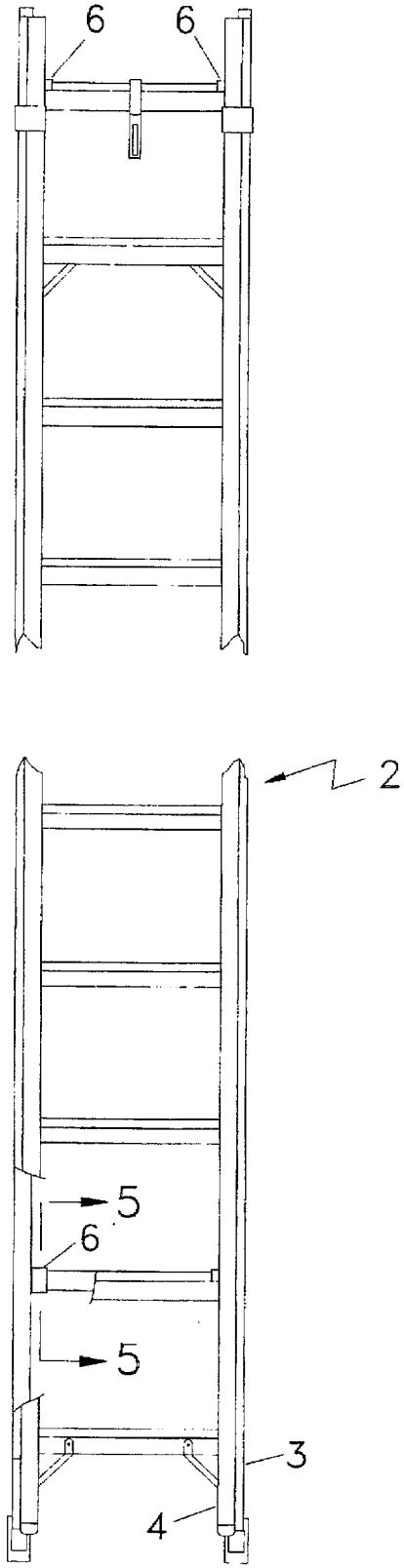
FIG. 2 is a view in from elevation, partly broken away, of the fly and base ladder shown in FIG. 1, disclosing the use of the novel wear sleeves of the present invention mounted at the top D rung and second from the bottom D-rung of the base ladder section.

Referring to FIGS. 1 and 2 of the drawings an extensible ladder 2 can be seen including base ladder section 3 and fly ladder section 4 mounted thereon. As can be particularly seen in FIG. 2 of the drawings base ladder section is provided with novel wear sleeves 6, here shown as mounted on the top D-rung and the second from the bottom D-rung of the base ladder sections. It is to be understood that the wear sleeve can be so contoured to accommodate mounting on rungs of other cross-sectional configurations and can be mounted on other rungs and other ladder sections depending upon the nature of the extensible ladder type and particularly where wear might occur between relatively moveable ladder sections.

Figure 3:
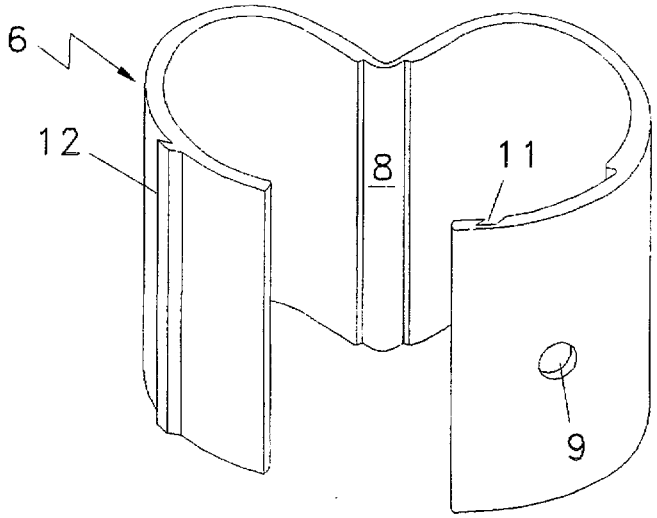
FIG. 3 is a view is perspective of the novel wear sleeve of the present invention.
Figure 4:
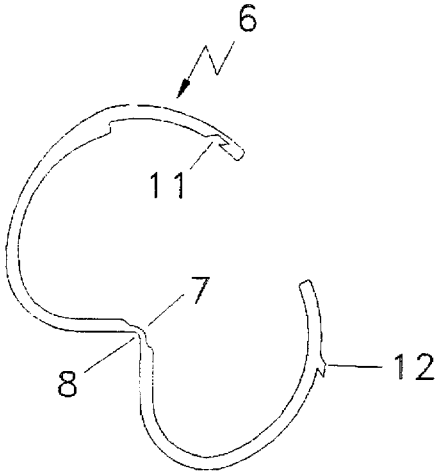
FIG. 4 is an enlarged view in end elevation of the war sleeve of FIG. 3, disclosing the wear sleeve in open position prior to mounting on a D-rung.
Figure 5:
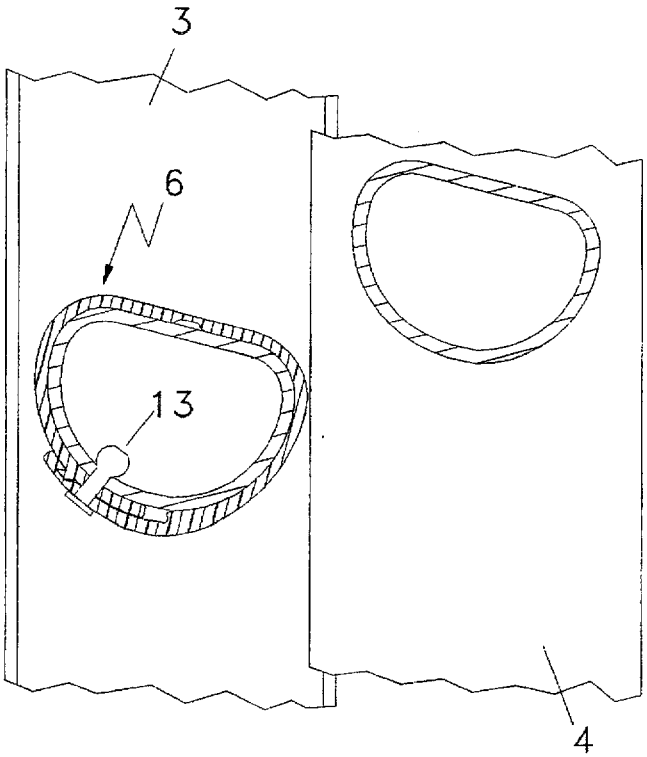
FIG. 5 is an enlarged sectional view taken along the line 5—5 of FIG. 2, disclosing the wear sleeve shown in FIGS. 3 and 4 in close, mounted in fixed position on a D-rung.

Referring to the isometric view of FIG. 3 of the drawings an enlarged novel wear sleeve 6 is disclosed. Wear sleeve 6 can be formed from any one of a number of suitable flexible, resilient wear materials and, in the advantageous embodiment of the invention as disclosed, is formed in substantially elongated, rectangular shape from a high density polyethylene material such as Phillips Marlex with a general thickness of 0.08 inches, a width of approximately 1.04 inches and a length sufficient to surround the external periphery of the D-rung to which it is to be mounted with the end portions thereof being in overlapping relation a preselected amount when the wear sleeve is in closed, mounted position on a D-rung. It is to be noted the wear sleeve 6 as disclosed is recessed in thickness at 7 to provide a hinge 8 and is tapered in thickness at one end portion thereof approximately twice the general thickness to accommodate the opposite wear sleeve end portion with which it overlaps when the sleeve is in closed, rung mounted position. (FIG. 5).

The material relief section 7 forming hinge 8 extends transversely across wear sleeve 6 normal to the longitudinal axis of the sleeve and intermediate opposite extremities of the sleeve so as to provide for open flexible and resilient manipulation around the D-rung periphery to which it is to be mounted and to readily allow for subsequent closing to grip and hold the wear sleeve in position when the sleeve is fastened in fixed, firm, position around the rung to which it is mounted so as to provide a wear surface between relatively moveable members.

As above described, wear sleeve 6 is sized in length to surround snugly the entire periphery of a portion of a preselected rung with the end portions of the wear sleeve 6 in overlapped position. The outer overlapping end portion of the sleeve 6 has a rivet receiving aperture 9 disposed therein and therethrough. This aperture 9 serves as an alignment and guide indicia to guide a suitable riveting tool (not shown) therethrough to and through the under overlapped end portion and the rung to which the sleeve has been mounted.

Further, the outer overlapping sleeve end portion is provided with a recessed slot 11 in the lower surface thereof. Slot 11 extends transversely across the width of wear sleeve 6 normal to the longitudinal axis of the sleeve and slopes inwardly at a suitable preselected angle to the extremity of the end portion. To mate with slot 11, the inner overlapped sleeve end portion is provided with a detent tongue 12 extending from the upper surface thereof transversely across the width so as to also be normal to the longitudinal axis of sleeve 6. Detent tongue 12 slopes outwardly at a preselected angle compatible with the angle of slope of recessed slot 11 and is compatibly sized and positioned from the overlapped end portion to matingly engage with slot 11 so as to facingly and firmly engage along a wear sleeve gripping plane, sleeve 6 being maintained in held or gripped relationship after the flexible and resilient sleeve has been snugly mounted on a preselected rung with the opposite end portions in overlapped relation as abovedescribed. With wear sleeve 6 so gripped with the ends matingly engaged without further added gripping means, it is a straightforward, economical and comparatively energy and labor saving step to drill or tap a hole with the appropriately aperture 9 aligned for guiding a drill tool passing through the overlapped portion of the wear sleeve 6 and the rung for the subsequent manufacturing step of fastening rivet 13 to fix the sleeve 6 in preselected position.

It is to be understood that the material of the wear sleeve, its geometry or configuration an the configuration of the associated mating slot and tongue can be varied by one skilled in the art in accordance with the geometry of the rung cross-section without departing from the scope or spirit of the present invention.

The invention claimed is:

1. An elongated wear protection sleeve for fastening to the periphery of an extremity of a preselected rail rung of one section of an extensible ladder having adjacent end-to-end ladder sections so that a portion of the wear protection sleeve is disposed between the face of a relatively moveable ladder rail of one end-to-end section and said preselected rung to which said sleeve has been fastened in an adjacent end-to-end section: comprising a flexible, plastic, elongated and resilient sleeve of substantially rectangular shape with transverse end portions having a material relief recess extending transversely thereacross normal to the longitudinal axis thereof and intermediate opposite extremities thereof to provide a hinge for flexible and resilient manipulation around the periphery of said rung, said wear sleeve being sized in length to snugly surround a preselected rung peripheral portion with said transverse end portions of said wear sleeve in overlapped position with the outer overlapping end portion of said sleeve having a rivet receiving alignment and guide aperture disposed therein to guide piercing and riveting tools therethrough to and through said inner overlapped end portion and said rung, said outer overlapping sleeve transverse end portion having a recessed slot in the lower surface thereof extending transversely thereacross normal to the longitudinal axis of said sleeve, said slot sloping inwardly at a preselected angle to the extremity of said end portion, said inner overlapped transverse end portion having a detent tongue extending from the upper surface thereof transversely thereacross also normal to the longitudinal axis of said sleeve, said detent tongue sloping outwardly at a preselected angle compatible with the angle of slope of said recessed slot in said outer sleeve transverse end portion and being positioned from the extremity of said overlapped transverse end portion to facingly and firmly engage along a gripping plane in wear sleeve holding relation when said flexible and resilient wear sleeve has been snugly mounted around the periphery of said preselected rung with said opposite transverse end portions thereof in overlapped relation.

2. A wear protection device for disposition between two relatively moveable members comprising:

an elongated wear sleeve having a first end and a second end, said sleeve being conformably mounted to a portion of at least one of said two relatively moveable members to provide a wear surface between said relatively moveable members;

a grip structure formed along said first and second ends of said sleeve for interlocking said first and said second ends and mounting said sleeve to said relative moveable member to define a mounted position for said wear sleeve; and a fastener guide formed in said wear sleeve, said wear sleeve having at least one opening in it for defining said fastener guide, said fastener guide adapted to receive a separate additional fastener in the mounted position of said wear sleeve.

3. The wear protection device of claim 2 wherein said flexible wear sleeve is sized to surround said portion of said relatively moveable member, said grip structure being adapted to hold said wear sleeve in said mounted position.

4. The wear protection device of claim 2 further characterized by a hinge portion between the first and second ends of said wear sleeve.

5. The wear protection device of claim 4 wherein said wear sleeve has a longitudinal axis, said hinge portion comprising at least one material relief section extending transverse of said longitudinal axis.

6. The wear protection device of claim 2 wherein said gripping structure comprises a recess portion along one of said first and said second ends of said wear sleeve and a detent portion in the other of said first and second ends of said wear sleeve, said recess and detent portion engaging one another in the mounted position of said wear sleeve.

7. The war protection device of slim 6 wherein said detent has a first face and said recess has a second face, said detent and recess being formed to engage in face to face relationship in the mounted position of said wear sleeve.

8. The wear protection device of claim 2 further including a fastener positioned in said fastener guide.

9. A wear protection for protecting at least a portion of a rung of an extension ladder comprising:

an elongated sleeve having a first end and a second end, said sleeve being conformably mountable to the portion of the rung to provide a wear surface;

a grip structure formed along said first and second ends of said sleeve for interlocking said sleeve to said rung; and a fastener guide formed in said sleeve.

10. The device of claim 9 wherein said sleeve has at least one opening formed in it, said opening defining said fastener guide, said fastener guide adapted to receive a separate fastener in the mounted position of said sleeve.

11. The device of claim 10 further including a fastener positioned in said fastener guide and adapted to lock said wear sleeve to said rung.

12. The device of claim 9 further including a hinge portion integrally formed with said sleeve intermediate said first and said second ends.

* * * * *

UNITED STATES PATENT AND TRADEMARK OFFICE

CERTIFICATE OF CORRECTION

PATENT NO. : 5,673,768

DATED : October 7, 1997

INVENTOR(S) : Schmitt et al.

It is certified that error appears in the above-identified patent and that said Letters Patent is hereby corrected as shown below:

Column 2, Line 8, delete "war" and insert therefor ---wear---;

Column 4, Line 41, delete "war" and insert therefor ---wear---; delete "slim" and insert therefor ---claim---;

Signed and Sealed this

Tenth Day of March, 1998

*Attest:*

*Attesting Officer*

BRUCE LEHMAN

*Commissioner of Patents and Trademarks*